United States Patent [19]

Lampus

[11] 4,034,529

[45] July 12, 1977

[54] REBAR BOLSTER FOR SOLID GROUTED WALLS

[76] Inventor: Donald L. Lampus, 109 Cornwall Drive, O'Hara Township, Allegheny County, Pa. 15238

[21] Appl. No.: 692,588

[22] Filed: June 3, 1976

[51] Int. Cl.[2] ..... E04B 2/40

[52] U.S. Cl. ..... 52/426; 52/687; 52/690

[58] Field of Search ..... 52/442, 428, 426, 687, 52/690, 563

[56] References Cited

U.S. PATENT DOCUMENTS

| | | | |
|---|---|---|---|
| 1,483,042 | 2/1924 | Coombs | 52/426 |
| 1,932,275 | 10/1933 | Kublanow | 52/604 X |
| 2,929,238 | 3/1960 | Kaye | 52/442 |
| 3,546,833 | 12/1970 | Perreton | 52/442 X |

FOREIGN PATENT DOCUMENTS

| | | | |
|---|---|---|---|
| 574,984 | 4/1959 | Canada | 52/428 |
| 707,479 | 4/1954 | United Kingdom | 52/564 |

*Primary Examiner*—Alfred C. Perham
*Attorney, Agent, or Firm*—Webb, Burden, Robinson & Webb

[57] ABSTRACT

A solid grouted wall is formed of layers of block with spaces being formed within the block or between block to accommodate rebar and concrete. A rebar support comprising two parallel and laterally spaced longitudinally extending rods and a plurality of cross rod members positioned therebetween are positioned on the face shells of the block so the cross rod members extend in the aforementioned spaces. Cross rod members each include at least one and preferably two substantially U-shaped troughs which extend below the plane of the longitudinally extending rods a predetermined distance and which accommodate the horizontally extending rebar. In addition, the respective cross rod members of the rebar supports can be aligned vertically from layer to layer so as to offer support for vertical rebars.

4 Claims, 3 Drawing Figures

REBAR BOLSTER FOR SOLID GROUTED WALLS

FIELD OF THE INVENTION

My invention is directed to a rebar bolster and, more particularly, to a solid grouted wall including such a rebar bolster for retaining horizontal and vertical rebar and for reinforcing mortar joints.

DESCRIPTION OF THE PRIOR ART

Presently, solid grouted block walls are generally constructed of specialty block having grooved webs to accommodate the rebar. Such block, as exemplified by U.S. Pat. Nos. 3,222,830 and 3,717,967, are generally difficult to manufacture and, therefore, the cost of the product is often prohibitive. In addition, the depth and the cross section of the grooves are virtually constant for all block as a result of the limited mold designs available for such specialty products.

Mortar joint reinforcement per se is known as exemplified by U.S. Pat. Nos. 3,183,628 and 2,929,238. However, such known designs only provide reinforcement in the mortar joint and do not provide positive means of retaining rebar to form solid beams or solid grouted walls. Individual support brackets have also been proposed primarily for concrete beams, see U.S. Pat. No. 3,530,634. However, such individual brackets require a certain precision in setting and are, therefore, time consuming to utilize. Such designs are not amenable to construction sites where rebar and rebar holders are subjected to the impact of concrete being forced in the aligned spaces of blocks.

SUMMARY OF THE INVENTION

My invention eliminates the need for specialty block to accommodate rebar for solid grouted block walls. In addition, it is extremely easy to provide various size rebar supports both as to the depth of positioning of the rebar and the size of the rebar which can be accommodated. Vertical reinforcement by rebars can also be accommodated with my support structure. My rebar support member further provides for a mechanical holding of the rebar in place while simultaneously reinforcing the mortar joint between block layers. In addition, my rebar support member can be utilized on solid grouted walls formed from dissimilar materials and is likewise amenable to a construction of modular walls.

My invention is a rebar support member or bolster for use in solid grouted walls. The support member includes longitudinally extending, parallel rods joined intermittently by cross rod members. Each cross rod member includes at least one substantially U-shaped trough bent formed in the cross rod member so as to provide an oepning to accommodate the rebar. The openings are aligned to adjacent cross rod members. Preferably two such troughs are bent formed in each cross rod member. The bolster is dimensioned so that the longitudinally extending rods are positioned on block faces to reinforce the mortar joints and the cross rod members are positioned in spaces formed between block faces to retain the rebar in place during the pouring of the concrete to form the solid grouted wall.

DESCRIPTION OF THE PREFERRED EMBODIMENTS

Figure 1:
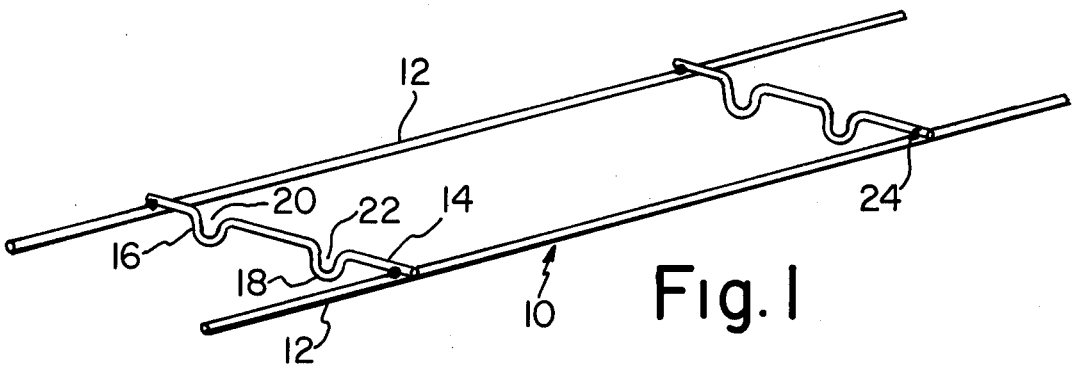
FIG. 1 is a perspective view of my rebar support member.

My rebar bolster, generally designated 10, is comprised of two longitudinally extending, parallel and spaced rods 12, FIG. 1. These rods 12 are joined at intervals by a plurality of spaced cross members 14. The cross members 14 are also made of metal rod and are secured to longitudinal rod 12 by a series of weldments 24. Cross members are generally positioned in overlapping relationship to the longitudinal rods 12 so that the weldments 24 are positioned on the upper surface of rods 12. By avoiding a flush fit between the cross member 14 and the longitudinal rod 12, additional mechanical bonding is achieved within the solid grouted wall as will be described hereinafter.

Each cross member 14 includes two identical U-shaped troughs 16 and 18 which are positioned along cross member 14 in spaced relationship to one another. These troughs are normally bent formed into the cross rod member prior to assembly. Trough 16 includes an opening 20 and trough 18 includes an opening 22 to accommodate the rebar. The openings 16 and 18 are generally in the plane of the rods 12 and the troughs 16 and 18 extend below said plane a predetermined distance to maintain the rebar at or below said plane. The size of the openings 20 and 22 and the depth of the troughs 16 and 18 are strictly dependent upon the size of the rebar to be supported and the desired depth to which the reinforcement is to be positioned within the open spaces of a wall prior to final grouting. The troughs can easily accommodate rebar up to 2 inches, whereas present blocks with integral grooves are limited to three quarter inch rebar. It will be understood that the number of U-shaped troughs positioned along a single cross member may vary. For example in some constructions, a single trough may be adequate, whereas in other constructions where a wide space between blocks or other materials is to be grouted, a plurality of such troughs may be necessary.

Figure 2:
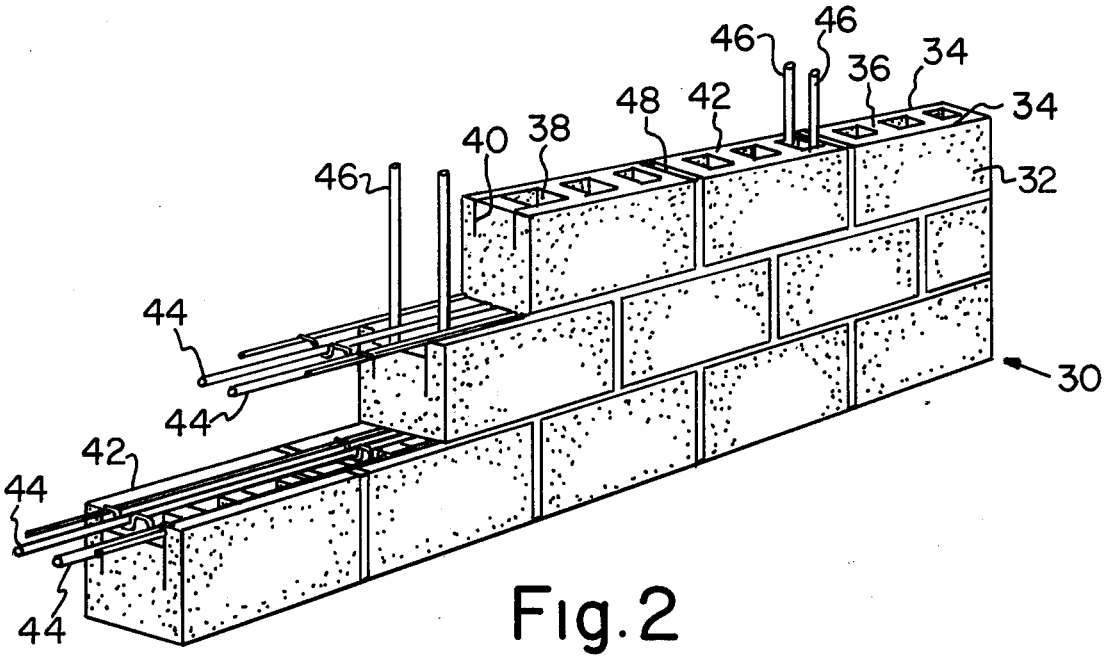
FIG. 2 is a perspective showing a partially constructed solid grouted wall.

A solid grouted wall, generally designated 30, is comprised of a plurality of block 32 positioned in end to end relationship in a row and also in layers, FIG. 2. A standard block 32, such as that normally referred to as "Bond Beam," will include block sides 34 and cross webs 36 forming spaces 38 therebetween. In order to accommodate rebar 44 extending longitudinally along the block, the webs 36 normally include slots 40 along each side so that the upper surface of each web can merely be knocked out as by a hammer to permit reinforcing bar to extend along the length of the wall. Other block such as "lintels" which have no cross webs can also be used to accommodate my rebar bolsters. Mortar 48 is positioned on the upper surface or face shells 42 of the block 32 to form the respective layers and between the block 32 to form the rows.

My rebar bolster 10 comes in lengths of 10 feet or more and is merely cut off to the desired length. The rebar bolster 10 is positioned on a row of block 32 with a longitudinal rod 12 positioned on each of the respective face shells 42 and the cross members 14 positioned in the spaces 38 formed between the block sides 34, FIG. 2. Horizontal rebar 44 is positioned in the respective troughs 16 and 18 which are in alignment for the various cross members 14 of a single rebar bolster 10. In addition to the horizontal rebar 44, which is now held suspended within the spaces 38 by the troughs 16 and 18, vertical rebar 46 can be employed. By merely positioning the rebar support 10 similarly from layer to layer, the cross members 14 are also in vertical alignment so that the vertical rebar 46 may merely be positioned against the cross members 14 and the horizontal rebars 44. After the wall 30 is completely constructed, concrete is poured into the open spaces which also are in substantial alignment so as to form a solid grouted wall properly reinforced both by vertical and horizontal rebar. In addition, the mortar joints between layers have been reinforced by the longitudinal rods 12 of the rebar support 10.

Figure 3:
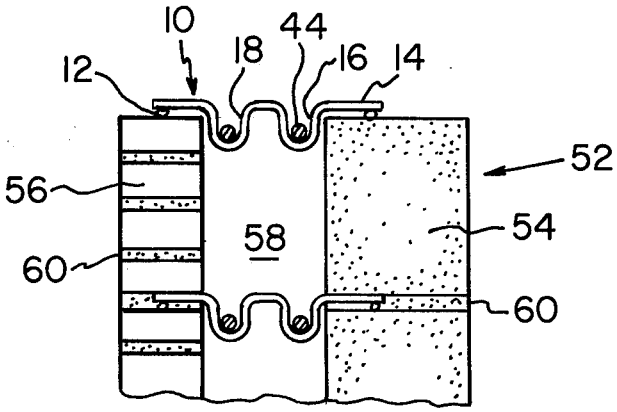
FIG. 3 is a section through a solid grouted wall constructed of dissimilar materials.

Some solid walls 52 are made of dissimilar materials, for example, a retaining wall having a brick face and a block interior, FIG. 3. The exterior surfaces are made of a plurality of brick 56 positioned in layers with appropriate mortar 60 therebetween. The inside wall is made of solid concrete block 54, also positioned in end to end relationship and in rows. My rebar bolster 10 is utilized by placing the longitudinal rods 12 on the one side on the brick face and on the other side on the block face with the cross members 14 therebetween in the spaces 58 formed between the block and the brick. After the wall 52 is constructed of the two independent walls and the rebar 44 is in place, the space 58 is filled in with concrete to form the solid grouted wall 52. Walls may also be formed of similar materials in block form or otherwise, e.g. stone, which are initially layered into two independent walls and thereafter formed into a single wall by solid grouting. My rebar bolster is equally applicable in such wall constructions.

In addition to providing a holder for the horizontally extending rebar between initially independent walls of dissimilar or similar materials, the vertical rebar can also be positioned adjacent the intersection of the horizontal rebar and the vertical cross member of the rebar bolster. At the same time, the mortar joints are being reinforced through the mechanical bonding formed by positioning the longitudinal rods of the support bracket in the mortar joints.

I claim:

1. In a solid grouted wall formed of layers of blocks, with each layer defined by a plurality of blocks positioned in end to end relationship and having parallel face shells and spaces therebetween, and rebar extending along said spaces, the improvement comprising rebar supports comprising two parallel and laterally spaced longitudinally extending rods and a plurality of cross rod members positioned between the rods in spaced relationship and welded to each of the parallel rods along a surface thereof, each cross rod member positioned in a space between face shells and including at least one substantially U-shaped trough bent formed in the cross rod member and extending below the plane of the longitudinally extending rods a predetermined distance to maintain the rebar at or below said plane, said trough in adjacent cross rod members being aligned to accommodate the rebar, said longitudinally extending rods positioned on adjacent face shells to reinforce mortar joints and said cross rod members being in substantially vertical alignment from layer to layer to provide support for vertically positioned rebar.

2. The solid grouted wall of claim 1, each cross rod member including two U-shaped troughs in spaced relationship.

3. In a solid grouted wall formed of layers of block in spaced and parallel relationship with layers of brick, concrete filling the spaces therebetween and rebar reinforcing said wall, the improvement comprising a rebar support comprising two parallel and laterally spaced longitudinally extending rods connected by parallel and spaced cross rod members, one of said longitudinally extending rods positioned in a mortar joint on a brick face between layers of brick and the other of said rods positioned in a mortar joint on a block face between layers of block, said cross rod members extending in said spaces filled by concrete and including at least one substantially U-shaped trough bent formed in the cross rod member and extending below the plane of the longitudinally extending rods a predetermined distance to maintain the rebar at or below said plane, said trough of adjacent cross rod members being aligned in a longitudinal direction and accommodating rebar and said cross rod members of adjacent rows being aligned vertically to provide support for vertically positioned rebar positioned at the intersection of the horizontal rebar and the cross rod members.

4. The solid grouted wall of claim 3, each cross rod member including two U-shaped troughs in spaced relationship.

* * * * *